US006931789B2

(12) United States Patent
Stout, Jr.

(10) Patent No.: US 6,931,789 B2
(45) Date of Patent: Aug. 23, 2005

(54) SAFETY GUARD FOR HINGED DOOR

(76) Inventor: Fred T. Stout, Jr., 8705 Sanctuary Dr., Kirtland Hills, OH (US) 44060

( * ) Notice: Subject to any disclaimer, the term of this patent is extended or adjusted under 35 U.S.C. 154(b) by 79 days.

(21) Appl. No.: 10/666,159

(22) Filed: Sep. 19, 2003

(65) Prior Publication Data

US 2005/0060939 A1 Mar. 24, 2005

(51) Int. Cl.[7] ..... E05D 11/00
(52) U.S. Cl. ..... 49/383; 160/40
(58) Field of Search ..... 49/383, 506, 384; 160/40, 229.1; 16/224, 355

(56) References Cited

U.S. PATENT DOCUMENTS

| | | | |
|---|---|---|---|
| 1,444,994 A | 2/1923 | White | |
| 1,894,102 A | 1/1933 | Kuenzel | |
| 2,694,234 A | 11/1954 | Roby et al. | 20/16 |
| 3,092,870 A | 6/1963 | Baer | |
| 3,319,697 A | 5/1967 | Krohn | 160/229 |
| 4,999,879 A | 3/1991 | Baer | |
| 5,419,084 A | 5/1995 | Sankey et al. | |

FOREIGN PATENT DOCUMENTS

| | | | |
|---|---|---|---|
| DE | 4207385 A1 * | 9/1993 | 49/383 |
| GB | 2 218 449 A | 11/1989 | E06B/7/28 |

* cited by examiner

*Primary Examiner*—Jerry Redman
(74) *Attorney, Agent, or Firm*—James A. Lucas; Driggs, Lucas, Brubaker & Hogg Co., LPA

(57) ABSTRACT

A protective guard is used to cover the gap formed between a hinged door and a door frame or doorjamb when the door is in the open position. The guard comprises several elements that are pivotally joined to one another using a C-clamp. One element is mounted on the face of the door and another element is joined to the frame or jamb. Each of these is joined to a transition element which in turn may be joined in succession to one or more channel elements. Optionally, the guard may include a retainer spring that serves to preserve the convex shape of the guard when the door is being pivoted between the open and the closed positions. The safety guard may be made out a wide variety of materials including metal, plastic, rubber and foam.

18 Claims, 4 Drawing Sheets

SAFETY GUARD FOR HINGED DOOR

FIELD OF THE INVENTION

The present invention relates to a safety device for use with a hinged closure such as a door to prevent injury to fingers that might otherwise become caught between the door and the doorjamb when the door is swung closed. The device has particular applicability as a child safety feature for household doors.

BACKGROUND OF THE INVENTION

In conventional installations, a door is mounted to a frame by two or more hinges which allow the door to pivot about a vertical axis when moving between an open and a closed position. The pivoted edge of the door generally fits closely with the adjacent doorjamb while leaving a substantial gap along the edge opposite the hinge when the door is open. It is therefore very easy for a person to insert an object in this gap when the door is open. Then when the door is closed, substantial leverage is applied to whatever object happens to have been inserted into the gap.

Injuries are often caused, especially to small children, by fingers being trapped between a door and a door frame or a doorjamb. Various designs for door guards have been proposed in the past to overcome this danger. For example, others have proposed the use of a web of plastic material stretched over the space between the door and the jamb when the door is open. However, these prior devices were deficient in one or more respects such as cost, ease of installation, reliability or effectiveness.

SUMMARY OF THE INVENTION

It is an object of the present invention to provide a guard which will provide adequate protection against a child getting a finger or other body part caught in the gap between the hinged edge of a door and a doorjamb.

Another object is to provide a guard that is economical to produce and simple to install.

These and other objects that will become apparent upon a full understanding of the present invention are achieved in accordance with the following description.

The invention relates to an elongated protective guard for the opening of a hinged door or a lid, comprising a plurality of elongated elements, each of which is pivotally joined to an adjacent element by a C-clamp. A first element is referred to as a mounting element. Two mounting elements are required, one adapted to be fastened to the door, and the other to a door frame or doorjamb. The mounting element has a generally planar surface terminating at first and second longitudinally extending edges. The planar surface of the mounting element includes means for securing the guard to a doorjamb or to the surface of a door. For example, one or more strips of VELCRO may be adhered to the mounting element, with the corresponding strip or strips adapted to be mounted on said doorjamb or door surface for engagement with the first strips. The element may be provided with mounting holes for securing to the door or the frame with threaded fasteners or nails. Adhesives such as epoxy resins or cyanoacrylates, or double-sided adhesive tape may likewise be used to secure the element to the door or the jamb. The first edge of the mounting element is aligned with the surface of the element thereby permitting the element to be flush mounted either on the door or on the frame or jamb. The second edge is bent at slightly more than a right angle with respect to the planar surface to form a flange having an inner semi-circular seat, and an outer contact surface. The contact surface comprises a planar portion and a curved portion. The planar portion of the contact surface forms an angle slightly greater than 90° with respect to the generally planar surface of the mounting element.

The mounting element is pivotally coupled to a transition element having a generally planar surface terminating at first and second longitudinally extending edges. The first edge forms a flange having an inner semi-circular seat, and an outer contact surface comprising a planar portion forming an angle slightly more than 90° with respect to the generally planar surface, and a curved portion, the contact surface being in contact with the corresponding contact surface of the first element. The second edge forms a second flange extending in the opposite direction to the generally planar surface, in a direction that is approximately 180° from the direction of the first flange. This second flange forms an inner semi-circular seat, and an outer contact surface comprising a planar portion forming an angle slightly more than 90° with respect to the generally planar surface and a semi-circular curved portion. The contact surface abuts the corresponding contact surface of the first element.

The mounting element is held in juxtaposition with the transition element using a C-clamp. The C-clamp comprises a base and two arms, each arm terminating in a semi-circular bead projecting toward the corresponding bead on the other arm. The semi-circular seat of the first edge of the mounting element pivotally engages the bead of one arm of the clamp, and the semi-circular seat of the first edge of the second element pivotally engaging the bead of the other arm. Typically, the sum of the radii of the outer curved portion of the contact surfaces is substantially constant throughout the range of rotation of the elements.

The transition element may be joined to a corresponding transition element attached to the second mounting element, but more typically is joined to a channel element. As with the mounting element and the transition element, the channel element comprises an elongated generally planar exposed surface, and two edges. Each of the edges of the channel element is shaped to form a flange, each flange extending in the same direction away from the exposed planar surface of the element to form a channel-shaped cross section. Both of the flanges terminate in a semicircular concave seat facing a corresponding seat on the other flange. When assembled, the semi-circular seat of the first edge of the transition element pivotally engages the bead of one arm of the clamp, and the semi-circular seat of the first edge of the second element, whether another transition element or a channel element, pivotally engages the bead of the other arm.

Depending upon the width of the gap between the door and the doorjamb, one or more channel elements may be joined to the transition elements or to one another in the same manner.

The guard may optionally include a shape retainer for maintaining a generally semi-circular shape and for precluding the elements from collapsing together as the door is closed. The retainer may comprise a spring for biasing the elements into an arc. A simple yet effective spring is a strip of generally flat spring steel or other metal that is joined to the underside of one or more of the elements. As the door is swung to the closed position, the underside of the elements presses against and deflects the spring, whereby the spring serves to resist the elements from folding in on one another. The planar portion of the element to which the spring is attached may be made thicker than the corresponding portions of the other elements to accommodate set screws, rivets or other fasteners that may be used to secure the spring to the element.

Typically, the guard is at least about 36" to 48" in length. Obviously, it can also extend from the top to the bottom of the door, particularly in the case of a split door such as a Dutch door.

The invention also relates to a hinged door assembly comprising a door and a doorjamb, the door joined to the jamb by at least one hinge for movement between an open and a closed position. A protective cover extends over at least a portion of the opening between the door and the jamb when the door is in the open position. The protective cover comprises a plurality of elements, and C-clamps pivotally holding each element against the next contiguous element.

Two of the elements are mounting elements, each having a generally planar surface terminating at first and second longitudinally extending edges. The first edge forms a flange having an inner semi-circular seat, an outer contact surface comprising a planar portion forming an angle that preferably is slightly greater than 90° with respect to the generally planar surface, and a curved portion. The second edge is aligned with the planar surface whereby one of the mounting elements is attached to the door and another element is secured to the doorjamb or frame.

A transition element is adjacent to each mounting element and likewise has a generally planar surface terminating at a first and a second longitudinally extending edge, the first edge forming a flange having an inner semi-circular seat, and an outer contact surface comprising a planar portion forming an angle slightly greater than 90° with respect to the generally planar surface, and a curved portion. The contact surface of the transition element is in contact with the corresponding contact surface of the first element. The second edge forms a flange that extends in the opposite direction from the first flange with respect to the generally planar surface of the element. The flange along the second edge likewise has an inner semi-circular seat, and an outer contact surface comprising a planar portion and a curved portion.

A C-clamp is used to couple each element to the next adjacent element. The clamp comprises a base and two arms, each arm terminating in a semi-circular bead projecting toward the corresponding bead on the other arm. The semi-circular seat of the first edge of an element pivotally engages the bead of one arm of the clamp, and the semi-circular seat of the first edge of the next adjacent element pivotally engages the bead of the other arm. The sum of the radii of the outer curved portion of the contact surfaces is substantially constant throughout the range of rotation of the elements.

Depending on the width of the gap between the door and the jamb when the door is fully open, the guard further may include one or more additional elements pivotally joined to the transition element, spanning the gap between the door when open and the doorjamb.

The invention also relates to the method of using the protective guard to prevent injuries when a hinged door is closed. The method includes mounting the guard made as described on the door and on the jamb on the side of the door opposite the hinges.

BRIEF DESCRIPTION OF THE DRAWINGS

The present invention will now be described with specific reference to the drawings in which.

DETAILED DESCRIPTION OF THE INVENTION

Figure 1:
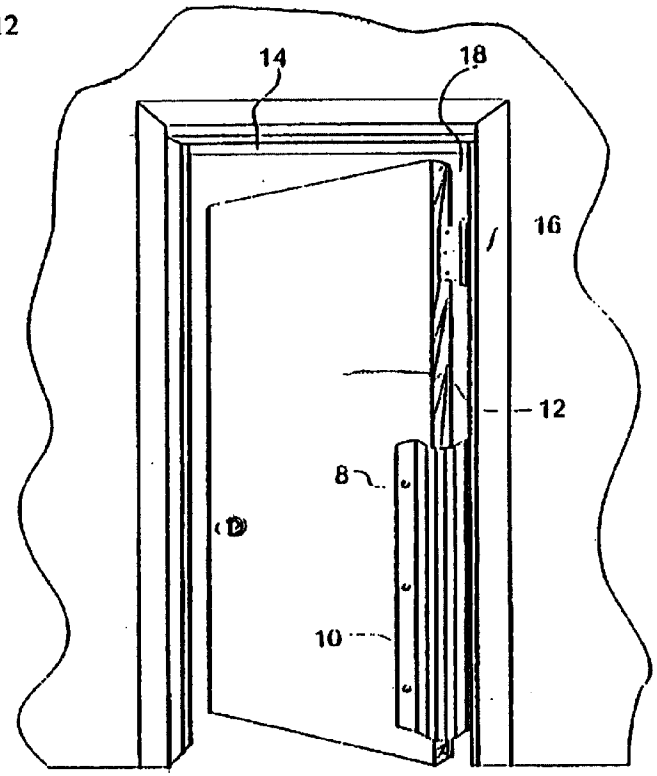
FIG. 1 shows the guard of the present invention installed on a hinged door.

Turning now to the drawings, FIG. 1 shows a door 12 pivotally joined to a doorjamb 14 by two or more door hinges, one of which is shown as 16, typically of conventional design. The door and the doorjamb may be made of wood, metal or plastic and their size, construction and details are well known in industry. When the door is closed, typically there is only a very small gap between the door and the jamb, often covered with a molding or trim piece. When the door is swung to the open position as shown in FIG. 1, a wedge-shaped gap 18 is created. This gap is easily large enough to accommodate the fingers or even the hand of an unsuspecting infant. Upon closing of the door, a tremendous amount of crushing or pitching force can be exerted against the finger, possibly with disastrous or at least very painful consequences.

Shown covering at least a portion of the gap 18 is a guard of the present invention. The details of the guard are not evident in FIG. 1. Suffice it to say that the guard is positioned with one edge secured with screws 8 or other fastening means to the door and the opposing edge secured to the doorjamb so that inquisitive fingers cannot enter the gap 18.

Figure 2:
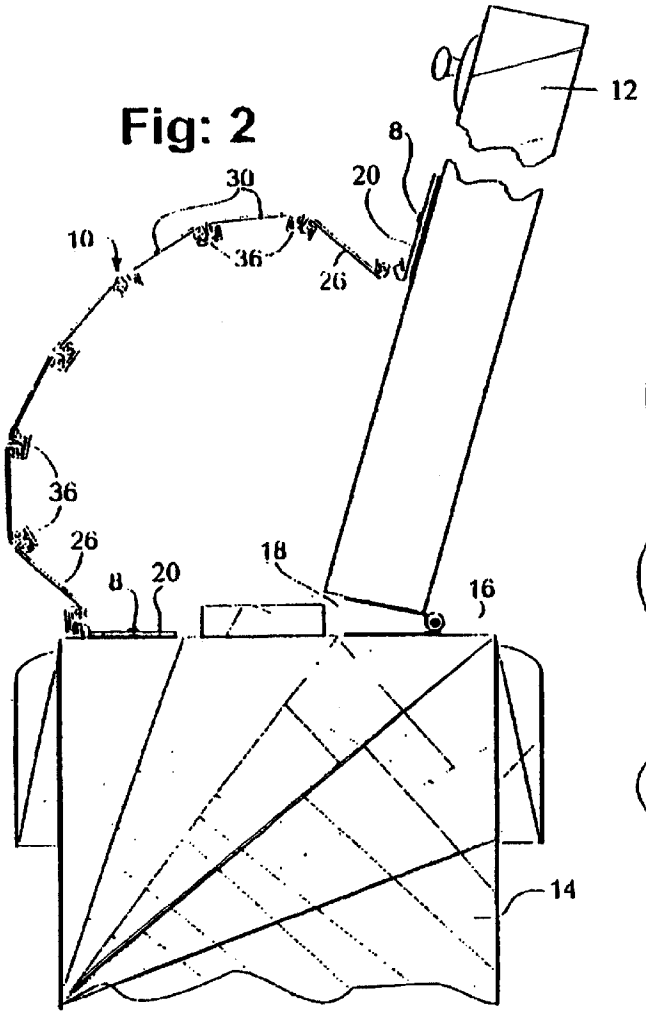
FIG. 2 is a top view of the guard assembly.

Looking at FIG. 2, there is shown the functional aspects of the guard 10 as it might appear when mounted on an open door. The guard 10 comprises a plurality of individual elements coupled to one another by C-clamps. Two mounting elements 20 are adapted to be attached to the door and the jamb. Next to the mounting elements are two transition elements 26 each having an outwardly turned flange and an inwardly turned flange. These elements are located next to one or more channel elements 30, each having two flanges facing the same direction with respect to the planar surface of the element. The flanges of adjacent elements are pivotally held together by a C-clamp 36.

Figure 3:
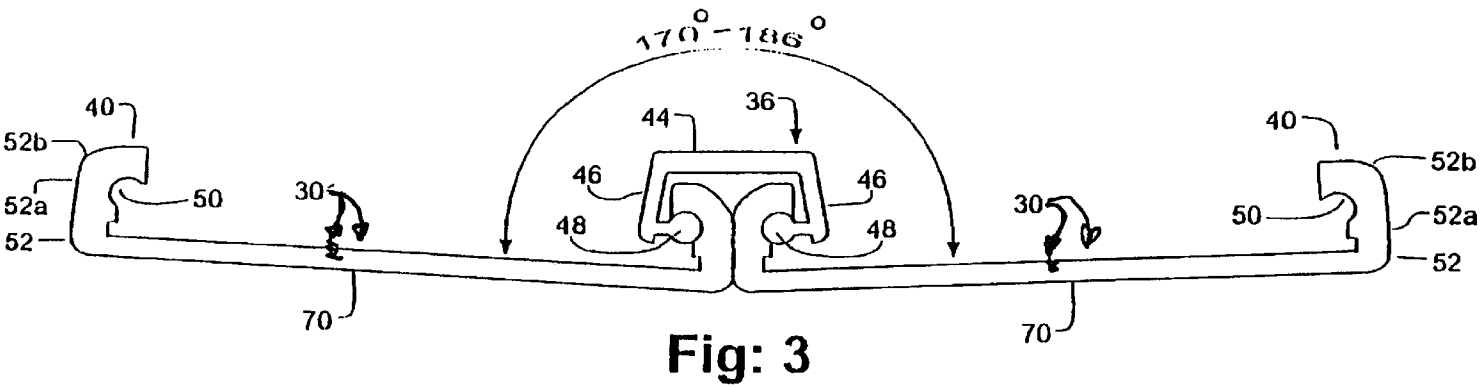
FIG. 3 shows two of the elements pivotally joined together using a channel clamp.

FIG. 3 is an enlarged view of two channel elements 30 held together with a C-clamp. Each of the elements includes a body 70 and two flanges 40 extending away from the exposed surface 32 of the body. Each flange has a concave seat 50 on the inside and a contact surface 52 on the outside comprising and a generally planar portion 52*a* terminating in a convex curved portion 52*b*. The C-clamp 36 comprises a base 44 and two arms 46 terminating in semi circular beads 48. The beads face one another and engage the semicircular seats 50 of one flange of each channel element 30. Preferably the planar portion 52 of the flanges form an angle that the slightly greater than 90° with respect to the body of the element. Thus, when the elements are fully open as shown in FIG. 3, they form an angle of less than 180° with respect to the body 70. A preferred angle between the body and the flanges is between 80° and 88° whereby the planar portion of the contact surface on the flanges of the two elements will limit the two elements to an opening of between about 160° and about 176°. To facilitate the smooth rotation of the two elements within the C-clamp, the radius of each seat matches the radius of the corresponding bead, and the radius of the convex curved portion of each flange is equal to ½ of the distance of the spacing between the two beads of the clamp. This defines the relationship with respect to all of the element flanges and C-clamps.

Figure 4:
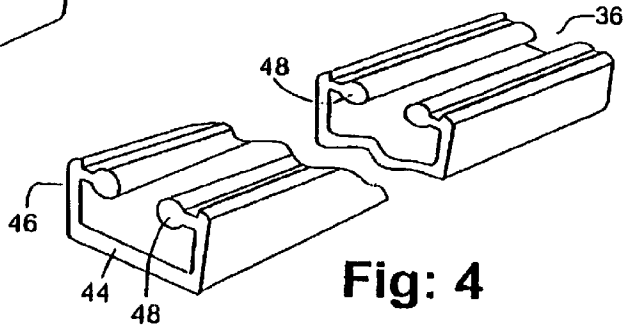
FIG. 4 is an enlarged view of a channel element used in FIG. 2.

FIGS. 4 through 8 show perspective views of the various components of the guard of the present invention. FIG. 4 shows the C-clamp 36 with a base 44 having two arms 46 terminating in a pair of beads 48 facing one another. The clamp preferably is made from the same material as the other elements of the guard. Therefore, if the elements are made from aluminum, the clamp preferably but not necessarily is made from aluminum as well. The space between the arms is sufficient to permit the clamp to be slid over the arms of two adjacent elements during assembly whereby the beads engage the seats of the elements and prevent the elements from separating while allowing the elements to pivot together within the clamp.

Figure 5:
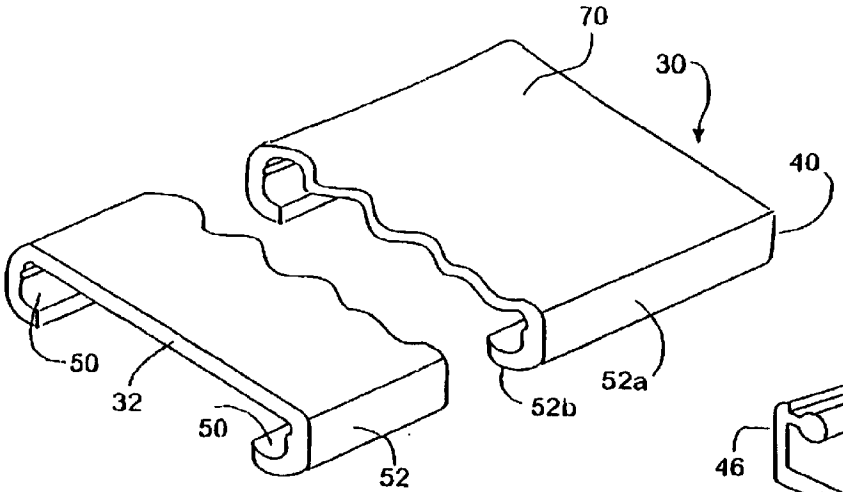
FIG. 5 is an enlarged view of a C-clamp used in FIG. 2.

FIG. 5 shows one of the channel elements 30 with a body 70 having an exposed planar surface 32, and two flanges 40. Each flange has a concave seat 50 on the inside, and a contact surface 52 on the outside comprising and a generally planar portion 52*a* terminating in a convex curved portion 52*b*. The concave and convex surfaces typically are semicircular in cross section. The guard will typically have two or more of these channel elements, depending on the width of the gap when the door is open and on the width of each individual element.

Figure 6:
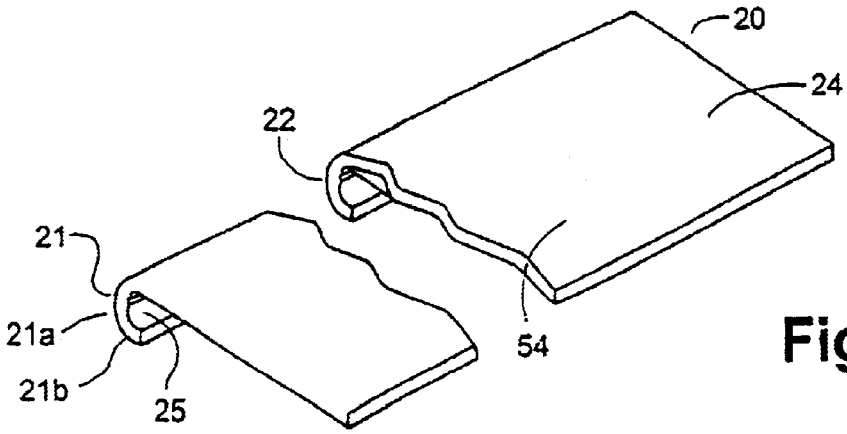
FIG. 6 is an enlarged view of a mounting element used in FIG. 2.

FIG. 6 shows one of the mounting elements 20. The planar surface 24 of the mounting element may include screw holes (not shown) for mounting the guard on the side edge of a door or doorjamb opposite the door hinge. Alternative means of attachment such as one or more strips of VELCRO may be used on the mounting elements to attach the guard to the door and the doorjamb. Still another alternative is the use of an adhesive resin or a strip of double faced adhesive. The mounting element has one flange 22 along one edge thereof. The flange has a concave seat 25 on the inside, and a contact surface 21 on the outside comprising and a generally planar portion 21*a* terminating in a convex curved portion 21*b*. The concave and convex surfaces typically are semicircular in cross section.

Figure 7:
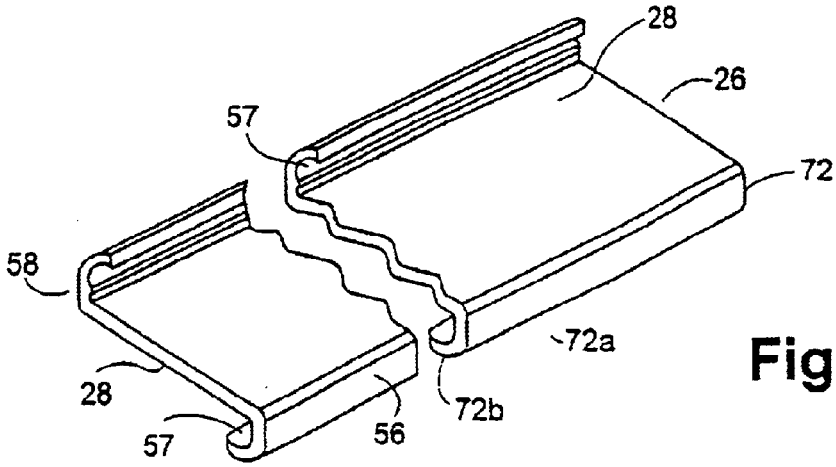
FIG. 7 is an enlarged view of a transition element used in FIG. 2.

A transition element 26 is shown in perspective in FIG. 7. This element contains planar surfaces 28, a first flange 56 extending in one direction from the planar surfaces and a second flange 58 extending in the opposite direction. The flanges each have a concave seat 57 on the inside, and a contact surface 72 on the outside comprising and a generally planar portion 72*a* terminating in a convex curved portion 72*b*. The concave and convex surfaces typically are semicircular in cross section. The transition element allows the safety guard to segue from a flush mounted element 20 into the semicircular curvature of the guard.

Figure 8:
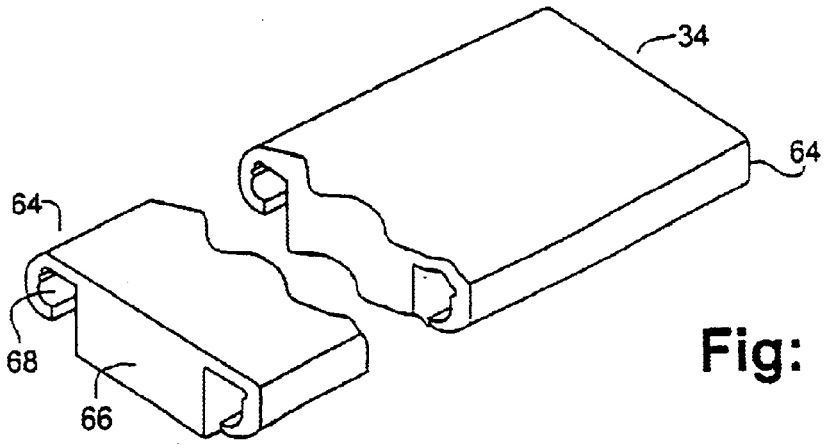
FIG. 8 is an enlarged view of a center element used in FIG. 2.
Figure 10:
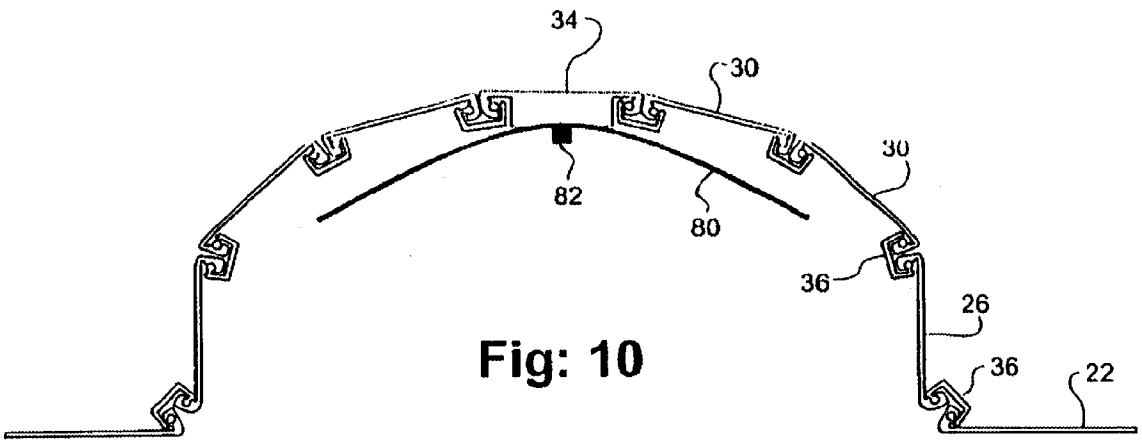
FIG. 10 shows the guard assembled with a leaf spring shape retainer.

In FIG. 8 is shown a center element 34. As with the channel elements, the center element has two flanges 64 extending in the same direction. The flanges terminate in a semicircular curve forming a concave seat 68 in the inside face of the flange. The body 66 of the center element is made thicker than a corresponding channel element so that it will be adapted to receive a retainer spring that serves to prevent door guard from collapsing upon itself as the door is closed. Such a spring is shown in the guard assembly of FIG. 10. The spring 80 typically is made from spring steel or other substance with a good elastic memory and is secured to the center element with one or more set screws or other suitable fasteners 82. The spring may be only one or two inches high even though the guard may extend 30 inches or more along the door. More than one spring may be spaced along the length of the guard to more effectively maintain the convex shape of the guard as the door is pivoted about the hinges from an open position to a closed position. The center element is otherwise dimensioned the same as the channel elements previously described with respect to the flanges, the concave seats and the contact surfaces.

Figure 9:
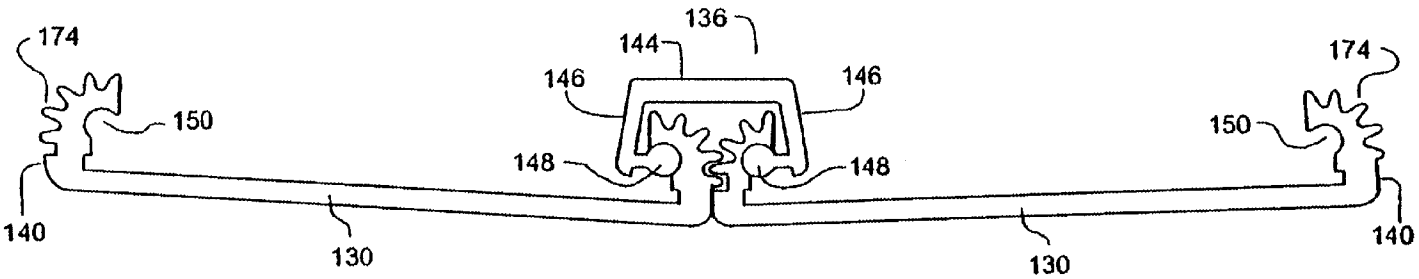
FIG. 9 is a top view of another variation of the present invention.

Another alternative of the invention is shown in FIG. 9. In this arrangement, the flanges 140 of the elements 130 include semicircular seats 150 as before. Opposite the seat, the flanges are provided with intermeshing gear teeth 174. The two channel elements 130 are held together by a C-clamp 136. As before the C-clamp comprises a base 144, two arms 146 and two beads 148 facing one another and engaging the semicircular seats 150 in the flanges 140 of the gear channel elements 130. Although this FIG. 9 shows two of the channel elements, it should also be understood that the arrangement of gears may also be used on the mounting elements, and the transition elements as well as the center element if used. It is also understood that the gears can be used for some of the pivots in the guard assembly but not for others.

The various elements of the protective cover may be made from any suitable material. For example, they may be extruded from aluminum or other light weight metal. Alternatively, they can be fabricated from a suitable rigid plastic such as polyethylene, polypropylene, an ethylene-propylene copolymer, polycarbonate, TEFLON, DELRIN or nylon. Yet another choice is to make the individual elements from a suitable foam material such as sponge rubber or polyurethane, or from a rubbery material such as neoprene. The elements and clamps can be shaped from wood, or may be provided with a wood grain appearance by embossing or by covering with a laminate. If the elements are made from metal, they can be fabricated by molding, machining, rolling, drawing, die casting or extruding. Likewise, if made from a thermoplastic or thermosetting polymer, molding, casting or extrusion can be used to produce the elements. Although the transition, channel and center elements have been described as having a planar surface, it should be understood that they may be slightly convex, generally conforming to the curvature of the guard when assembled.

As an example of the size of the component parts of a typical door safety guard made from extruded aluminum, the individual elements can be between about ½" and 1" wide with the flanges being about 0.1" to 0.2" high. The radius of the semicircular portion of the contact surfaces of the flanges may be from about 0.05 and 0.08" while the radii of the seats would be about 0.01" and about 0.04". The corresponding width of the C-clamp to pivotally hold adjacent elements together can be between about 0.015" and about 0.035" while the height of the arms would be between about 0.1" and 0.25". The spacing between the axes of the two inwardly facing beads depends on the thickness of the element flanges, and can vary from about 0.1" to about 0.2".

It should be pointed out that the guard can be sized to whatever length may be required to protect the lower portion of the door where infants and small children are likely to encounter injury. Alternatively, the guard can extend the entire vertical length of the door, thereby providing the added advantage of substantially closing the air passageway between the edge of the door and the doorjamb thereby greatly decreasing drafts, dust and loss of heat or air conditioned air.

The present invention can likewise be used on swinging doors and bi-fold doors, as well as those mounted on traditional hinges and/or piano hinges. To provide an adequate degree of protection, it becomes necessary to install one of these safety devices on both of the vertical sides of the door, and on both sides of the door frame, thereby providing a shield irrespective of which direction the door is swinging. The invention is also useful for guarding against pinching when used along the edges of wooden or metal boxes or other containers wherein the potential exists for pinching fingers when the lid of the box or other container is closing. Furthermore, the invention can find use as a protective cover for the doors of motor vehicles such as cars and trucks, as well as for the tail gates of trucks.

While the invention has been described in combination with specific embodiments thereof, there are many alternatives, modifications, and variations that are likewise deemed to be within the scope thereof. Accordingly, the invention is intended to embrace all such alternatives, modifications and variations as fall within the spirit and scope of the appended claims.

What I claim is:

1. An elongated protective guard comprising a) first and second mounting elements, each element having a generally planar surface terminating at first and second longitudinally extending edges, one edge forming a flange having a concave semi-circular seat, and a contact surface comprising a planar portion and a convex semi-circular portion, one of the mounting elements adapted to be attached to an edge of a door along a gap and the second mounting element adapted to be attached to one of a doorjamb and door frame;

b) at least one additional element adjacent each mounting element, having a generally planar surface terminating at first and second longitudinally extending edges, each edge forming a flange having a concave semi-circular seat, and a contact surface comprising a planar portion and a convex semi-circular portion;

c) a C-clamp pivotally joining one of said first and second mounting elements and said at least one additional element together, said clamp comprising a base and two arms, each arm terminating in a semi-circular bead projecting toward the corresponding bead on the other arm, the semi-circular seat of the flanged edge of one of the mounting elements pivotally engaging the bead of one arm of the C-clamp, and the semi-circular seat of one of the edges of said at least one additional element pivotally engaging the bead of the other arm whereby the contact surface of each mounting element is in contact with a corresponding contact surface of the at least one additional element.

2. The guard according to claim 1 wherein the sum of the radii of the convex semi-circular portion of the contact surfaces is substantially constant throughout the range of pivotal rotation of the mounting elements and said at least one additional element.

3. The guard according to claim 1 wherein the generally planar surfaces of the mounting elements and said at least one additional element when adjacent to one another form an angle less than 180° with respect to each other when all of the elements are fully extended with the planar contact surfaces touching one another.

4. The guard according to claim 3 wherein the generally planar surfaces form an angle of not greater than about 174°.

5. The guard according to claim 1 wherein the planar surface of each mounting element includes means for securing the guard to one of said doorjamb and a surface of said door.

6. The guard according to claim 5 wherein the securing means is selected from the group consisting of VELCRO fasteners, with a first fastener strip adapted to be mounted on one of said doorjamb and said door frame, and a second fastener strip adapted to be mounted on said door surface for engagement with the first strip, mounting holes in one of said first and second mounting elements for securing to one of the doorjamb or the door frame with threaded fasteners or nails, and adhesives.

7. The guard according to claim 1 wherein the at least one additional element is a transition element wherein one flange extends in the opposite direction from the other flange with respect to the generally planar surface of the at least one additional element.

8. The guard according to claim 1 wherein said at least one additional element further including a channel element having a generally planar surface forming a body portion and terminating said first and second longitudinally extending edges.

9. The guard according to claim 8 further including means for precluding all of the elements from collapsing together, said means comprising a spring joined to at least one of the first and second mounting elements and the at least one additional element for biasing all of the elements into an arc.

10. The guard according to claim 9 wherein the at least one spring is fastened to said channel element, the body portion of which is sufficiently thick to receive and hold at least one fastener.

11. The guard according to claim 8 wherein each of the first and second mounting elements is pivotally joined to said at least one additional element in a form of a transition element, each transition element is pivotally joined to one channel element, and each channel element is pivotally joined to another channel element.

12. The guard according to claim 1 wherein the elongated length is at least about 36" and wherein the guard is adapted to be mounted along a vertical edge of the door.

13. A hinged door assembly comprising a door and a doorjamb, the door joined to the doorjamb by at least one hinge for pivotal movement between an open and a closed position, the assembly further including a protective guard over at least a portion of an opening between the door and the doorjamb when the door is in the open position, the protective guard comprising a) a first element having a generally planar surface and mounted along a vertical edge of the door, said element having first and second longitudinally extending edges, the first edge forming a flange having an inner semi-circular seat, and an outer contact surface having a planar portion and a curved portion;

b) a second element mounted vertically on the doorjamb and having a generally planar surface having first and second longitudinally extending edges, the first edge forming a flange having an inner semi-circular seat, and an outer contact surface comprising a planar portion and a curved portion;

c ) at least one additional element adjacent each mounting element, having a generally planar surface terminating at first and second longitudinally extending edges, each edge forming a flange having an inner semi-circular seat, and a contact surface comprising a planar portion and a semi-circular portion; and d) a C-clamp comprising a base and two arms, each arm terminating in a semi-circular bead projecting toward the corresponding bead on the other arm, the semi-circular seat of the first edge of one of said first and second elements pivotally engaging the bead of one arm of the clamp, and the semi-circular seat of the first edge of said at least one additional element pivotally engaging the bead of the other arm, whereupon the outer contact surfaces of the flanges of adjacent said first and second elements and said at least one additional element are in pivoting contact with one another.

14. The assembly according to claim 13 wherein the first and second elements are mounting elements, and each mounting element is joined to said at least one additional element in a form of a transition element having a second edge that forms a flange which extends in the opposite direction from the first flange with respect to the generally planar surface of the element, the flange along the second edge having an inner semi-circular seat, and an outer contact surface comprising a planar portion and a curved portion.

15. The assembly according to claim 14 wherein the planar surface of one of said first and second elements and said one additional element includes means for securing the guard to the doorjamb or to a planar surface of the door opposite a hinge.

16. The assembly according to claim 13 wherein the sum of the radii of the curved portion of the contact surfaces of all of the elements is substantially constant throughout a range of rotation.

17. A method of preventing injuries upon closing of a hinged door comprising attaching a protective cover on a door and on a doorjamb on a side of the door opposite the hinges, said protective cover comprising a plurality of elongated elements pivotally joined to form an arc over a gap, the cover including a) a first mounting element having a generally planar surface mounted along a vertical edge of the door, said element having first and second longitudinally extending edges, the first edge forming a flange having an inner concave seat, and an outer contact surface comprising a planar portion and a convex curved portion;

b) a second mounting element mounted vertically on the doorjamb and having a generally planar surface having first and second longitudinally extending edges, the first edge forming a flange having an inner concave semi-circular seat, and an outer contact surface comprising a planar portion and a convex curved portion;

c) at least one additional element adjacent a mounting element, having a generally planar surface terminating at first and second longitudinally extending edges, each edge forming a flange having a concave semi-circular seat, and a contact surface comprising a planar portion and a convex semi-circular portion, the contact surface being in contact with the corresponding contact surface of the mounting element;

d) a C-clamp comprising a base and two arms, each arm terminating in a semi-circular bead projecting toward the corresponding bead on the other arm, the semi-circular seat of the first edge of one of said first and second mounting elements pivotally engaging the bead of one arm of the clamp, and the semi-circular seat of the first edge of said at least one additional element pivotally engaging the bead of the other arm.

18. The method according to claim 17 wherein the planar surface of one of the first and second mounting elements and said at least one additional element includes means for securing the guard to the doorjamb or to a surface of a door.

* * * * *